US006477817B1

(12) United States Patent
Yurick

(10) Patent No.: US 6,477,817 B1
(45) Date of Patent: Nov. 12, 2002

(54) CONCRETE FORM PANEL HANGER FOR BRICKLEDGE FORMS OR OTHER OBJECTS

(75) Inventor: Michael R. Yurick, Walled Lake, MI (US)

(73) Assignee: Michael Yurick, Walled Lake, MI (US)

( * ) Notice: Subject to any disclaimer, the term of this patent is extended or adjusted under 35 U.S.C. 154(b) by 0 days.

(21) Appl. No.: 09/237,852

(22) Filed: Jan. 27, 1999

Related U.S. Application Data

(60) Provisional application No. 60/103,055, filed on Oct. 5, 1998.

(51) Int. Cl.[7] ..... E04G 11/36

(52) U.S. Cl. ..... 52/699; 52/701; 249/34

(58) Field of Search ..... 52/699, 701, 96, 52/94; 249/35, 39, 207, 183, 34, 208, 14, 63, 177

(56) References Cited

U.S. PATENT DOCUMENTS

| | | | | |
|---|---|---|---|---|
| 920,787 A | | 5/1909 | Sullivan | |
| 1,109,433 A | * | 9/1914 | Leydecker | 249/34 |
| 1,273,033 A | * | 7/1918 | Clifford | 52/96 |
| 1,628,316 A | | 5/1927 | Heltzel | |
| 1,787,799 A | * | 1/1931 | Soule et al. | 249/39 |
| 2,298,837 A | * | 10/1942 | Oswald | 249/207 |
| 2,340,439 A | | 2/1944 | Stroben | |
| 2,614,311 A | * | 10/1952 | Shook | 249/183 |
| 2,978,779 A | * | 4/1961 | Tatsch | 52/220.1 |
| 3,422,585 A | | 1/1969 | Dismukes | |
| 3,662,507 A | | 5/1972 | Espeland | |
| 3,674,234 A | | 7/1972 | Davin | |
| 3,780,976 A | * | 12/1973 | Messier | 249/14 |
| 3,999,735 A | * | 12/1976 | Brownlee | 249/19 |
| 4,257,571 A | * | 3/1981 | Franks | 249/207 |
| 4,427,173 A | * | 1/1984 | MacKay | 249/39 |
| 4,550,535 A | * | 11/1985 | Drogosch | 52/60 |
| 4,592,176 A | * | 6/1986 | Van Herpen | 52/96 |
| 4,836,487 A | | 6/1989 | Ringler | |
| 4,955,579 A | | 9/1990 | Lee | |
| 5,076,535 A | | 12/1991 | Vetter | |
| 5,098,059 A | | 3/1992 | Sawyer | |
| 5,174,083 A | | 12/1992 | Mussell | |
| 5,337,534 A | * | 8/1994 | Nasca | 52/745.21 |
| 5,400,212 A | | 3/1995 | Hanson | |
| 5,535,556 A | | 7/1996 | Hughes, Jr. | |
| 5,670,076 A | | 9/1997 | Leek | |
| 5,706,620 A | * | 1/1998 | De Zen | 52/220.2 |
| 5,788,875 A | | 8/1998 | Walser | |
| 5,979,841 A | * | 11/1999 | Piraneo et al. | 248/95 |
| 6,017,014 A | * | 1/2000 | Maguire | 249/91 |
| 6,176,462 B1 | * | 1/2001 | Jansen | 249/3 |

OTHER PUBLICATIONS

Sketch showing prior art brickledge hanger.

* cited by examiner

*Primary Examiner*—Lanna Mai
*Assistant Examiner*—Phi Dieu Tran A
(74) *Attorney, Agent, or Firm*—Carlson, Gaskey & Olds

(57) ABSTRACT

A concrete form panel hanger for hanging objects from concrete form panels generally includes a body portion which is secured to the object. An end of the body portion is secured removably to a concrete form panel. Preferably, a wall spaced away from and extending generally parallel to the body portion extends from the end of the body portion. A rib of the form panel is inserted between the wall and the body portion to secure the hanger to the form panel.

4 Claims, 1 Drawing Sheet

CONCRETE FORM PANEL HANGER FOR BRICKLEDGE FORMS OR OTHER OBJECTS

This application claims priority to U.S. Provisional Application Ser. No. 60/103,055, filed Oct. 5, 1998.

BACKGROUND OF THE INVENTION

The present invention provides a device for hanging a brickledge form or other object from a concrete basement wall form panel.

Basement walls for many homes constructed today are poured concrete. Inner and outer form panels are placed around the perimeter of the basement. Concrete is then poured between the inner and outer form panels to form the basement walls.

Homes with a brick facade require a brickledge to be formed on the outer perimeter of the basement wall. Currently, in order to form the brickledge, wooden brickledge forms are nailed along the upper inside edge of the outer concrete form panel. When the concrete is formed between the inner and outer concrete form panels, the brickledge forms displace the concrete. When the concrete cures and the outer panels and brickledge forms are removed, a brickledge is formed around the upper edge of the outer perimeter of the basement wall.

It is often necessary to secure other objects, such as windows to the concrete form panels. Securing the brickledge forms, windows and other objects to the outer concrete form panels is time-consuming. The labor for securing these items to the form panels can be expensive.

SUMMARY OF THE INVENTION

The present invention provides a hanger for hanging objects, such as brickledge forms, from concrete form panels. Each hanger generally comprises a body portion and a wall spaced away from and extending generally parallel to the body portion. The body portion includes a plurality of holes through which nails or other fasteners can be inserted.

For hanging brickledge forms, an outer concrete form panel includes a reinforcing rib extending outwardly from an upper edge of the outer concrete form panel. The hanger is secured to the concrete form panel by inserting the rib between the wall and the body portion of the hanger. The body portion of the hanger extends inwardly past the outer panel. A brickledge form, such as a 2×4 or other beam is secured to the body portion by nails through the holes in the hanger. The brickledge form is thus secured adjacent the upper end of the inside of the outer form panel.

The concrete is then poured between the outer and inner form panels. The concrete forms around the brickledge form, forming the brickledge. After the concrete cures, the outer and inner panels and brickledge form are removed, leaving a basement wall with a brickledge. The panel hanger is then removed from the outer panel and the brickledge form is then removed from panel hanger for subsequent reuse.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
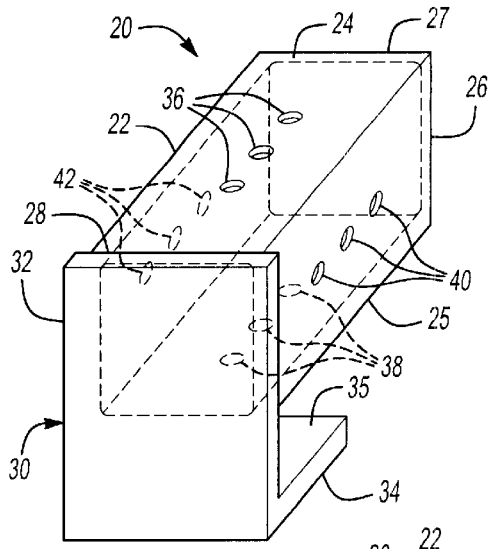
FIG. 1 is a perspective view of the form hanger of the present invention.

The present invention provides a panel hanger 20, shown in FIG. 1, which facilitates hanging a brickledge form (such as a 2×4) adjacent an outer concrete form panel. As can be seen in FIG. 1, the panel hanger 20 generally comprises a hollow body portion 22 comprising an upper wall 24 opposite and generally parallel to a lower wall 25. Generally parallel side walls 26 are positioned between the upper wall 24 and lower wall 25. The body portion 22 includes opposite first and second ends 27, 28. The body portion 22 is preferably approximately five and a half inches in length from the first end 27 to the second end 28.

An L-bracket 30 has two generally perpendicular walls 32, 34. The first wall 32 of the L-bracket 30 is welded or otherwise secured to the second end 28 of the body portion 22. The second wall 34 extends generally parallel to the lower wall 25 of the body portion and spaced away approximately one half inch from the lower wall 25 to form a recess 35.

A first plurality of longitudinally spaced holes 36 are formed in the upper wall 24. A second plurality of holes 38 are formed in the lower wall 25 and vertically aligned with the holes 36 in the upper wall 24. Similar third and fourth pluralities of holes, 40, 42 are formed in the side walls 26.

Figure 2:
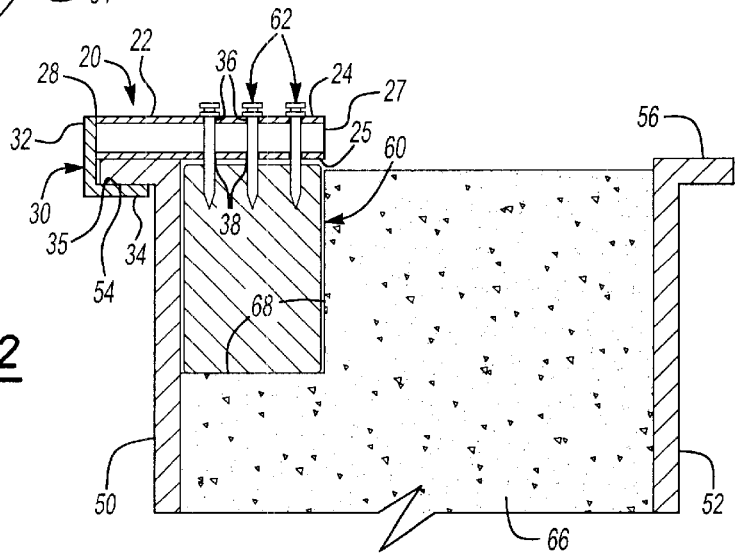
FIG. 2 is a sectional view of the form hanger of FIG. 1 in use, secured to an outer form panel.

FIG. 2 is a sectional view showing the panel hanger 20 in use. FIG. 2 illustrates an outer concrete form panel 50 and an inner concrete form panel 52 each having reinforcing ribs 54, 56 extending outwardly from an upper edge of the panels 50, 52, respectively. According to a method of the present invention, the panel hanger 20 is first secured to the upper rib 54 of the outer panel 50 by inserting the rib 54 into the recess 35 of the panel hanger 20. The body portion 22 extends inwardly past the outer panel 50. A brickledge form 60, such as a 2×4, is then secured adjacent the upper end of the outer form panel 50 by nails 62 through at least some of the holes 36 and 38. Alternatively, the holes 38 may be offset in different directions from the holes 36 so that the nails 62 are secured to the form 60 at different angles.

Subsequently, when the concrete 66 is poured between the outer and inner form panels 50, 52, the concrete 66 forms around the brickledge form 60. When the concrete 66 cures, the outer and inner panels 50, 52, brickledge form 60, and panel hanger 20 can be removed, leaving the basement wall 66 having a brickledge 68. The panel hanger 20 is then removed from the outer panel 50 and the brickledge form 60 is removed from the panel hanger 20. The panel hanger 20 and brickledge form can be re-used subsequently.

Figure 3:
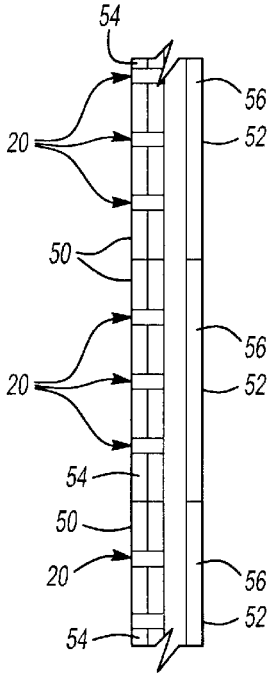
FIG. 3 is a top view of a section of the outer panel of FIG. 2, including a plurality of the panel hangers of FIG. 1.

FIG. 3 is a top view of a section of the concrete form panels 50, 52 of FIG. 2. As can be seen, many panel hangers 20 would be utilized on each of the outer form panels 50 and each of the brickledge forms 60. The panel hangers 20 would be spaced at generally regular intervals around the perimeter of the wall.

Figure 4:
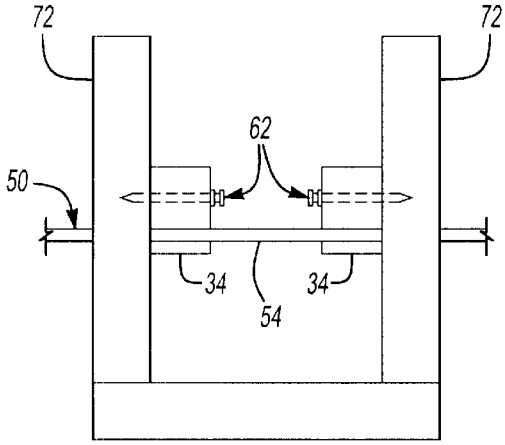
FIG. 4 illustrates the panel hanger of FIG. 1 secured another object.

FIG. 4 illustrates the panel hanger 20 secured to a form panel 50. Nails 62 are inserted through the holes 40, 42 in the side walls 26 and secured to boards 72 which extend vertically above the form panel 50.

The panel hanger 20 of the present invention facilitates hanging the brickledge form 60 more efficiently. Further, the panel hanger 20 can be used with most current commercially available form panels 50, 52. The hanger 20 could also be utilized for securing any other object to the panel 50 or 52, such as windows.

It should be recognized that any dimensions given or shown in the drawings are exemplary only, and that particular dimensions could be varied for particular applications. Further, other variations are possible which are also within the scope of the invention. For example, the body portion could be solid, rather than hollow. Other fasteners, such as screws, bolts, clamps or clips could be utilized in place of the nails 62. There may be other ways of securing the hanger 20 to the form panel 50, 52 which may be dictated by the shape or configuration of the panel 50, 52.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A method for securing a plurality of brickledge forms to a plurality of form panels including the steps of:

a) placing a plurality of form panels at least partially about a perimeter of a basement; and b) securing a plurality of hangers to each of the form panels;

c) securing each of the hangers to one of a plurality of brickledge forms;

d) pouring concrete adjacent the plurality of form panels;

e) displacing the concrete with the brickledge forms;

f) allowing the concrete to cure adjacent the plurality of form panels and partially around the brickledge forms;

g) removing the brickledge forms and form panels from the cured concrete; and h) forming a brickledge in the cured concrete with the brickledge forms.

2. The method of claim 1 further including the step of:

i) placing a plurality of bricks on the brickledge after said step h).

3. A concrete wall construction assembly:

a plurality of basement concrete form panels each connected at least partially about a perimeter, each of said basement concrete form panels includes a rib extending outwardly from an upper edge, each of said basement concrete form panels having an upper surface and a generally perpendicular inner major surface;

a plurality of hangers, each of said plurality of concrete form panels secured to a plurality of said hangers, said plurality of hangers secured to said ribs of said concrete form panels and abutting the upper surfaces of the concrete form panels;

an object removably secured to the plurality of hangers and having a first surface abutting an underside of the hanger and a second surface generally perpendicular to tie first surface, the second surface parallel to and abutting the inner major surface of the basement concrete form panels below the upper surface of the form panel;

concrete adjacent the inner major surface of the basement concrete form panels, said concrete at least partially displaced by ale object.

4. A concrete wall construction assembly:

plurality of concrete form panels each connected at least partially about the perimeter of a basement, each of said concrete form panels includes a rib extending outwardly from an upper edge;

a plurality of hangers, an object removably secured to the plurality of hangers each of said plurality of concrete form panels secured to a plurality of said hangers, said plurality of hangers secured to said ribs of said concrete form panels, wherein each said hanger includes:

an upper wall opposite and generally parallel to a lower a wall;

a pair of generally parallel side walls positioned between the upper wall and lower wall;

an L-bracket having a first wall secured to an end of the body portion and perpendicular to the upper wall and a second wall extending generally parallel to the lower wall of the body portion and spaced away from the lower wall to form a recess, said rib of said form panel disposed in said recess; and said body including a first plurality of longitudinally spaced holes and a second plurality of longitudinally spaces holes, a plurality of fasteners each disposed in one of said first plurality of longitudinally spaced holes and one of said second plurality of longitudinally spaced holes.

* * * * *

UNITED STATES PATENT AND TRADEMARK OFFICE

CERTIFICATE OF CORRECTION

PATENT NO. : 6,477,817 B1
DATED : November 12, 2002
INVENTOR(S) : Yurick

It is certified that error appears in the above-identified patent and that said Letters Patent is hereby corrected as shown below:

Column 4,
Line 12, delete “tie” and insert -- the --.
Line 18, delete “ale” and insert -- the --.

Signed and Sealed this

Twenty-fifth Day of March, 2003

JAMES E. ROGAN
*Director of the United States Patent and Trademark Office*